United States Patent [19]

Leroy

[11] Patent Number: 5,020,821

[45] Date of Patent: Jun. 4, 1991

[54] SKI AND SAFETY BINDING ASSEMBLY

[76] Inventor: Dominique Leroy, 68, rue du Colonel de Rochebrunne, F-92380 Garches, France

[21] Appl. No.: 397,480

[22] PCT Filed: Dec. 17, 1987

[86] PCT No.: PCT/FR87/00507

§ 371 Date: Aug. 14, 1989

§ 102(e) Date: Aug. 14, 1989

[87] PCT Pub. No.: WO89/05679

PCT Pub. Date: Jun. 29, 1989

[51] Int. Cl.[5] ..... A63C 5/02

[52] U.S. Cl. ..... 280/603; 280/607; 280/618

[58] Field of Search ..... 280/603, 607, 609, 613, 280/627, 633, 634, 618, 620, 636

[56] References Cited

U.S. PATENT DOCUMENTS

| | | | |
|---|---|---|---|
| 2,545,209 | 3/1951 | Meehan | 280/603 |
| 3,884,315 | 5/1975 | Fox | 280/603 |
| 4,155,568 | 5/1979 | Galich | 280/603 |
| 4,316,618 | 2/1982 | Sampson | 280/613 |
| 4,361,344 | 11/1982 | Hull et al. | 280/613 |
| 4,408,779 | 10/1983 | Shekter | 280/607 |
| 4,645,228 | 2/1987 | Bertonneau | 280/603 |

FOREIGN PATENT DOCUMENTS

| | | | |
|---|---|---|---|
| 1478120 | 8/1969 | Fed. Rep. of Germany | 280/603 |
| 2237212 | 2/1973 | Fed. Rep. of Germany | 280/603 |
| 2215250 | 8/1974 | France . | |
| 2497459 | 7/1982 | France | 280/607 |
| 2599986 | 12/1987 | France . | |

*Primary Examiner*—Andres Kashnikow
*Assistant Examiner*—Brian J. Johnson
*Attorney, Agent, or Firm*—Beveridge, DeGrandi & Weilacher

[57] ABSTRACT

The body of a ski has a front portion, a middle portion and a rear portion which are normally aligned longitudinally. The middle portion has a fixing device for securing a boot thereto, and the fixing device is releasable to release the boot from the ski when a predetermined vertical force is exerted upwardly on the boot relative to the middle portion. A front coupling connects the front portion to the middle portion, and a rear coupling connects the rear portion to the middle portion. The couplings are releasable in response to lateral forces which exceed a predetermined magnitude on the respective front and rear portions.

8 Claims, 3 Drawing Sheets

SKI AND SAFETY BINDING ASSEMBLY

BACKGROUND OF THE INVENTION

The present invention relates to a ski and safety binding assembly.

Hitherto, skis have been made as one piece and have been equipped with safety bindings for the boots generally comprising a front stop allowing lateral release and a rear heel-piece allowing release of the boot in the vertical direction in the event of excessive forces.

This design, although it has proved successful in many respects, neverthless has a certain number of drawbacks which the present invention aims to overcome.

On the one hand, if the safety binding is released, the entire ski becomes detached from the boot. The total loss of maneuverability resulting therefrom can be particularly inconvenient when skiing off-piste, i.e. in deep snow.

On the other hand, in view of their length, skis made as one piece are bulky and are often difficult to transport.

Moreover, a ski is generally made, with regard to its dimensions (length, width), its rigidity, flexibility or responsiveness, and its shape, so as to be suitable for a specific style of skiing (downhill, slalom, skiing on-piste, skiing off-piste, acrobatic skiing, monoskiiing, etc.), so-called multipurpose skis representing only a more or less satisfactory compromise. Consequently, a skier wishing to practice different styles of skiing must have several different skis corresponding to these different styles and all equipped with safety bindings.

SUMMARY OF THE INVENTION

The present invention relates to a ski and safety binding assembly which allows a ski, after release of the safety binding following an excessive lateral force, to retain a certain maneuverability, which facilitates transportation of the ski and safety binding assembly, and which, at a low cost, can be simply adapted for the practise of different styles of skiing.

In the ski and safety binding assembly according to the invention, the ski is divided into three parts comprising a front part, a rear part and a middle part. The middle part comprises means for fixing a boot with release in the vertical direction in the event of excessive forces. The middle part, the front part and the rear part comprise means for fixing the front part and the rear part to the middle part with lateral release in the event of excessive forces.

Consequently, in the ski and safety binding assembly according to the invention, part of the safety fixing means, namely that allowing release in the lateral direction, is transferred to the ski itself, such that in the event of excessive lateral force on the front part or on the rear part of the ski, this part separates from the middle part to which the boot remains fixed. In the event of release of one of these fixing means, the ski therefore retains partial maneuverability obtained by the middle part and the rear part or the front part which remains integral with the middle part. In order to transport the skis, the front part and/or the rear part is/are separated from the middle part, which enables the overall length to be reduced by a third or even more than half. Finally, by using front parts and rear parts having different shapes, which all fit onto the same middle part, it is possible to adapt the ski so that different styles may be practiced.

Preferably, the middle part has at the front and at the rear lateral-release fixing means and the front part and the rear part have at the rear and at the front a shape allowing cooperation with the said releasable fixing means of the middle part.

In this manner all the releasable fixing means are grouped together on the middle part, thus enabling the front part and the rear part to be simplified and the cost of these two parts to be reduced, which parts can be exchanged with a view to adapting the ski to different styles, while the middle part which groups together the fixing means always remains the same.

According to a preferred embodiment of the invention, the fixing means provided on the middle part comprise at the front, on the one hand, and at the rear, on the other hand, of the middle part a pair of opposite lateral jaws mounted pivotably about vertical pins and receiving between them in a removable manner a retaining head of corresponding shape arranged at the rear end of the front part and at the front end of the rear part. On the middle part there are provided, moreover, means for keeping the jaws of each pair in the closed position, a position in which the jaws retain between them the heads, and for allowing opening of the jaws in the event of an excessive lateral force on the front part or the rear part.

In order to improve the connection of the front part and the rear part with the middle part, it is advantageous for the middle part to have, in longitudinal vertical section, an H-shaped cross-section, the jaws being mounted between the pairs of opposite arms of the H. The front part and the rear part thus have, one at rear and the other at the front, a flat end section of reduced thickness capable of being inserted with sliding adjustment between the opposite arms of the H of the middle part.

In order to improve the positioning of the front part and the rear part relative to the middle part, it is advantageous for the opposite arms of the H of the middle part to be equipped with balls biased by springs so as to project on the opposite faces of the arms. The end sections of reduced thickness of the front part and the rear part comprise on their side hollows receiving the said balls when the retaining head of the front part and of the rear part is gripped between the closed jaws.

The jaws are advantageously kept in the closed position by balls biased by springs and cooperating with hollows on the jaws.

The force of these springs is adjustable so as to allow adjustment of the retaining force, i.e. the lateral force under which at least one of the jaws opens with a view to release.

According to a preferred embodiment, the force of the ball springs cooperating with the two jaws situated on a same side of the middle part of the ski can be adjusted by an ordinary adjusting member.

This adjusting member may consist preferably of a screw comprising a conical end acting by means of two opposite push-pieces on the said springs biasing the balls keeping the jaws in the closed position.

BRIEF DESCRIPTION OF THE DRAWINGS

With reference to the attached schematic drawings, a description is given below in greater detail of an illustrational and non-limiting embodiment of a ski and safety binding assembly according to the invention; in the drawing.

DESCRIPTION OF THE PREFERRED EMBODIMENT

Figure 1:
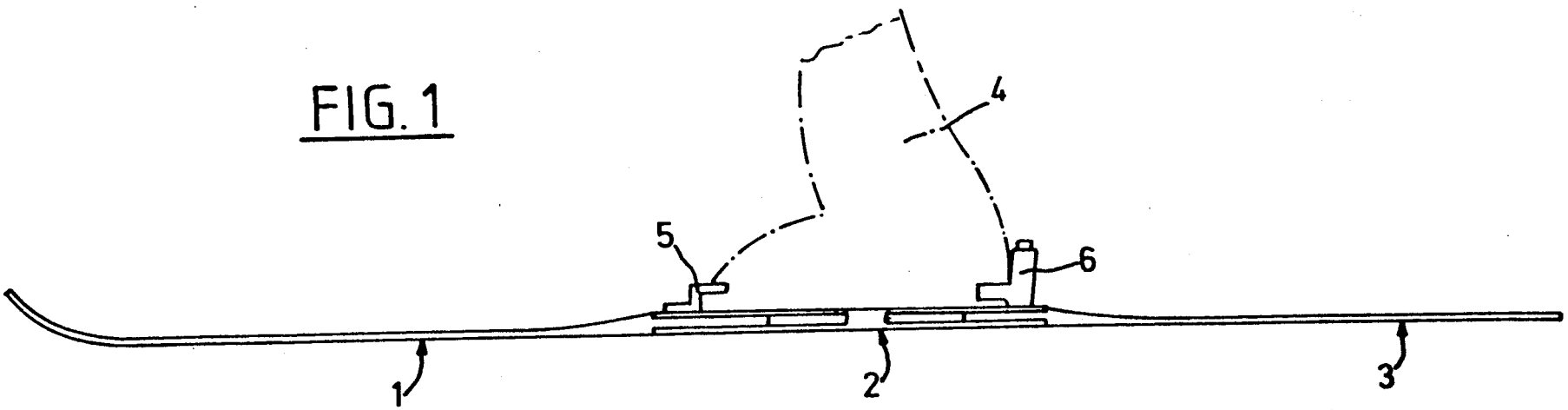
FIG. 1 is a side view of an assembly according to the invention.
Figure 2:
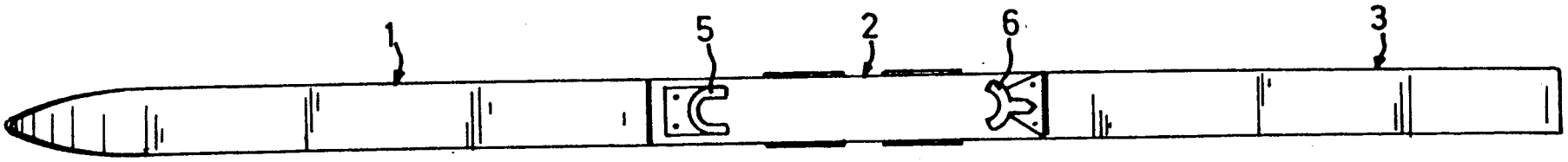
FIG. 2 is a plan view of this same assembly.

According to FIGS. 1 and 2, and ski and safety binding assembly comprises a ski divided into three positions or parts, namely a front part 1, a middle part 2 and a rear part 3. These parts or portions are longitudinally aligned, and their lower surfaces are also aligned.

The middle part 2 forms the thickest and most rigid part of the ski and has a length slightly greater than the length of a ski boot 4 shown schematically in dot-dash lines. The boot 4 is fixed onto the middle part 2 by means of a rigid front stop 5, i.e. without the possibility of release, and a rear heel-piece 6 allowing release vertically upwards.

The boot 4 is therefore fixed to the middle part 2 of the ski with the possibility of upwards release (safety in the case of a forward fall), but without the possibility of lateral release.

Lateral safety is ensured by a connection, with lateral release, of the middle part 2 with the front part 1 and with the rear part 3.

Figure 4:
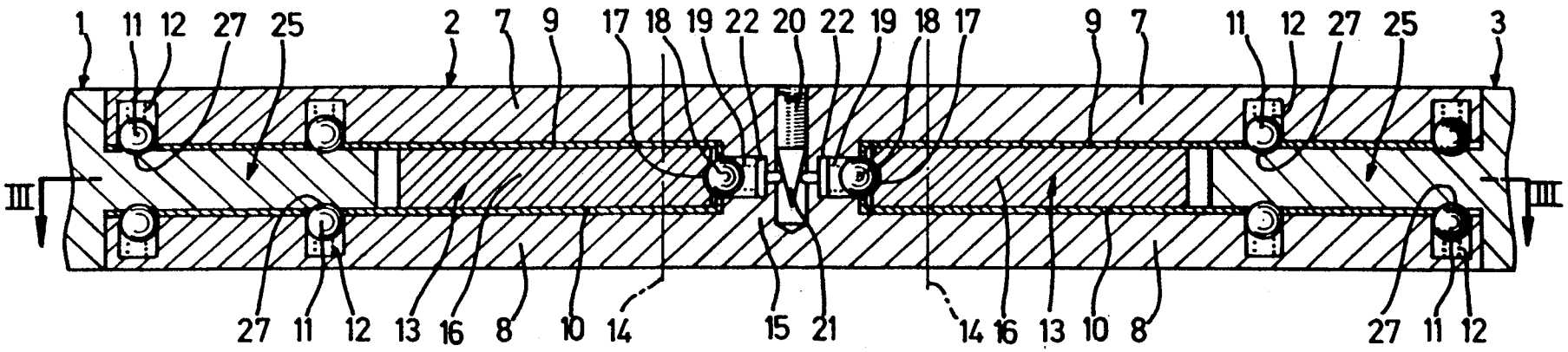
FIG. 4 is a vertical section along IV—IV of FIG. 3.

As shown in greater detail in FIG. 4, the middle part 2 having, in plan view, a substantially rectangular shape has, in vertical longitudinal section, a substantially H-shaped profile. The arms 7 of one side of the H forming the upper face of the middle part 2 and the arms 8 of the other side of the H forming the lower face of the middle part 2 are equipped, on their parallel opposite faces, with a thin plate 9, 10 made of a material having a good wear resistance and preferably a low coefficient of friction. These plates 9 and 10 serve moreover as retaining elements for balls 11 which are mounted in blind holes formed in the opposite faces of the arms 7, 8 and which are biased by springs 12 such that the balls 11 project slightly from the opposite faces of the plates 9, 10 of the arms 7, 8. In the example shown, each arm 7, 8 comprises four balls 11.

Between each pair of opposite arms 7, 8, two jaws 13 are mounted pivotably about vertical pins 14 in the vicinity of the two opposite lateral edges of the middle part 2 and of central portion 15 of the H-shaped profile of this part 2. Each jaw 13 has a retaining part 16 in the form of a hook, curved in the direction of the opposite jaw 13. At its end opposite to the hook 16, i.e. directed towards the central portion 15 of the H, each jaw 13 has a hollow 17 inside which there is able to engage a ball 18 mounted in a blind hole of the central portion 15 and biased by a compression spring 19 in the direction of the jaw 13 so as to project outside the central portion 15. An adjusting screw 20 with a conical end 21 is engaged from the top of the middle part 2 inside the central portion 15, between the blind holes for the balls 18 intended to cooperate with the hollows 17 of the two jaws 13 situated on one side of the part 2, one being oriented towards the front and the other towards the rear. A push-piece 22 is inserted between each spring 19 and the conical end 21 of the screw 20, such that insertion of the screw 20 to a greater or lesser depth enables the push-pieces 22 to be pushed back to a greater or lesser extent and therefore the springs 19 biasing the balls inside the hollows 17 of the jaws 13 to be compressed to a greater or lesser extent.

A tension spring 23 is arranged between the central portion 15 and each jaw 13 so as to bias the latter in the direction of the opposite jaw 13.

In the middle of the width of the middle part 2, the central portion 15 of the H comprises, on each side, i.e. towards the front and towards the rear, a stop block 24 made from a material with a low coefficient of friction.

The front part 1 and the rear part 3 of the ski have, one at the rear and the other at the front, the same shape designed to cooperate with the middle part 2, as described above. A description is given below of this shape for the front part 1, but this description also applies to the rear part 3.

The front part 1 has, at the rear, an extension in the form of a flat section 25 with a thickness substantially equal to the distance between the plates 9, 10 of the two opposite arms 7, 8, in such a way that this section 25 can be inserted with sliding adjustment between the said arms. At its free end part, the section 25 which has moreover the same width as the middle part 2 is formed as a retaining head 26, the external contour of which corresponds to the internal contour of the hooks 16 of the jaws 13 when the latter are closed, i.e. when they occupy the position in which the balls 18 are engaged in the hollows 17. In this position, the head 26 bears against the block 24 which ensures its positioning in one longitudinal direction of the ski, while the positioning in the other longitudinal direction and the transverse positioning are ensured by the jaws 13.

The section 25 has moreover hollows 27 in the locations situated opposite the balls 11 when the head 26 is gripped in position between the jaws 13. The balls 11 and the hollows 27 thus play a part in the correct positioning of the section 25 relative to the arms 7, 8 and hence of the front part 1 relative to the middle part 2 of the ski.

Figure 3:
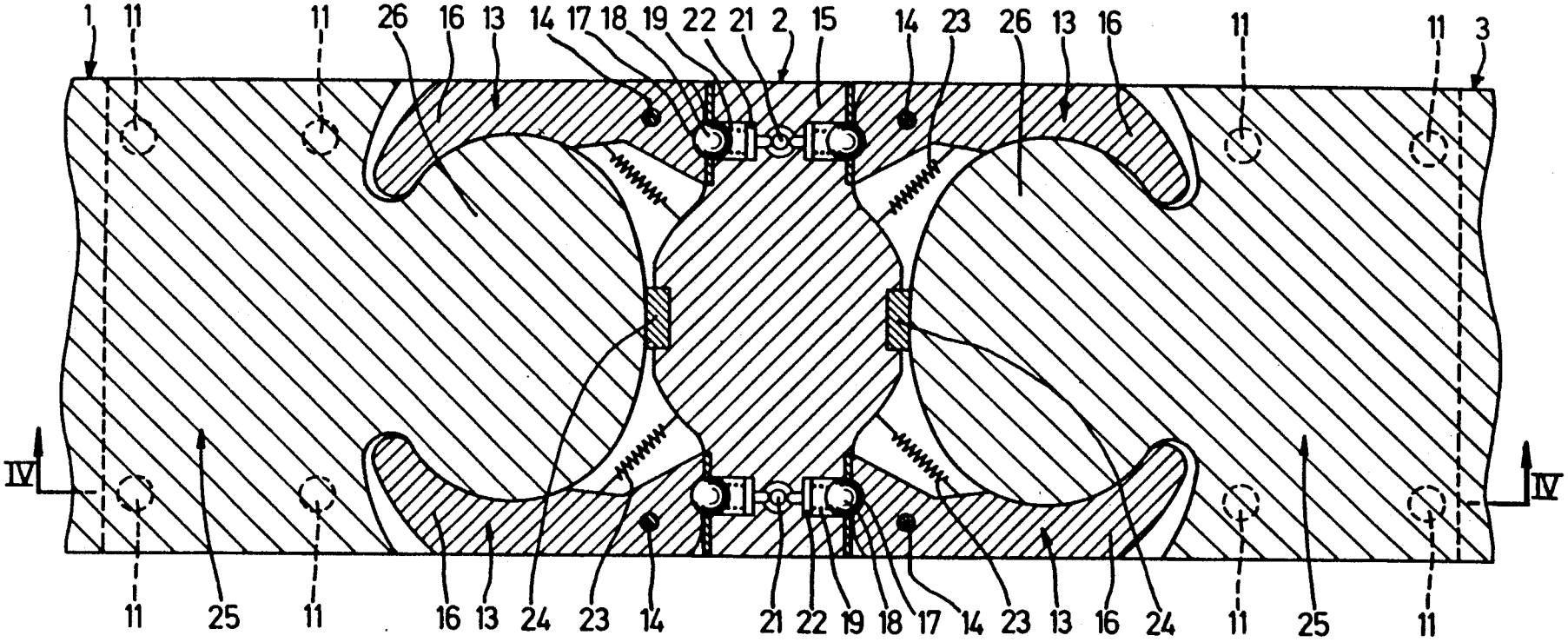
FIG. 3 is a partial horizontal section, on a larger scale, of the assembly according to FIGS. 1 and 2, at the location of the middle part, a section made along III—III of FIG. 4.

When the jaws 13 grip between them the head 26 of the rear section 25 of the front part 1 of the ski, as shown in FIG. 3, the balls 11 being engaged in the hollows 27 of the section 25, the front part 1 of the ski is kept in alignment with the middle part 2.

If a lateral force is exerted on the front part 1, the latter is able, upon exceeding a threshold defined by the retaining force of balls 11 of the middle part 2 on the section 25 of the front part 1, through the force of the return springs 23 of the jaws 13 and in particular through the adjustable retaining force of the balls 18 on the jaws 13, to perform a lateral movement relative to the middle part 2. As a result of this lateral movement, at least one of the two jaws 13 gripping the head 26 pivots outwards and opens, thus freeing the head 26, such that the front part 1 is disconnected from the middle part 2 and can separate completely from it.

Owing to the action of the return springs 23, the jaws 13 close.

If a lateral force is applied to the rear part 3, the latter is correspondingly disconnected from the middle part 2 once a predetermined force threshold is exceeded.

In order to connect again the front part 1 (or the rear part 3) to the middle part 2, the head 26 is introduced between the jaws 13 and the jaws 13 are closed until they are brought into the position shown in FIG. 3, in which the balls 18 engage in the hollows 17 of the jaws 13. The front part 1 is thus brought into alignment with the middle part 2 and the balls 11 engage in the hollows 27, thereby ensuring correct positioning of the front part 1 relative to the middle part 2.

By inserting the adjusting screws 20 to a greater or lesser depth, it is possible to adjust the threshold for activation of the lateral-release fixing means (jaws 13).

It goes without saying that the embodiment described above and illustrated by the attached drawings has been provided merely by way of an indicative and non-limiting example and that several modifications and variations are possible within the scope of the invention.

Thus, the lateral-release fixing means, instead of being grouped together on the middle part 2, could also be partially or even entirely transferred onto the front part 1 and onto the rear part 3. Moreover, these means could also be different from those shown and described, provided that they perform the same function.

I claim:

1. A ski and safety binding combination, comprising, a ski body including a front portion, a middle portion and a rear portion;

said portions being longitudinally aligned and having aligned lower surfaces to define a bottom surface of a ski;

front coupling means on said front portion and said middle portion for connecting the front and middle portions in longitudinal alignment; said front coupling means being releasable in response to a predetermined lateral force on said front portion;

rear coupling means on said rear portion and said middle portion for connecting the rear and middle portions in longitudinal alignment; said rear coupling being releasable in response to a predetermined lateral force on said rear portion;

fixing means secured on an upper surface of said middle portion for securing a boot to said middle portion, said fixing means being operable to release said boot from said middle portion when there is a predetermined upward force on a boot relative to said middle portion.

2. The apparatus of claim 1 wherein the middle portion in longitudinal vertical section has an H-shaped cross section with parallel horizontal arms, at least one of said front portion and said rear portion having a flat extension section of reduced thickness which is slidably inserted between said arms of the middle portion.

3. The apparatus of claim 2 in which the flat extension section has ball-receiving recesses formed therein, and the horizontal arms of the middle portion are provided with balls, and spring means biasing said balls in to said ball-receiving recesses.

4. The apparatus of claim 1 in which at least one of said coupling means includes a pair of opposed lateral jaws pivotally mounted on vertical pins on said middle portions, one of said front and rear portions having a retaining head located within said jaws and retained thereby, means for biasing the jaws to a closed position to retain the head therebetween, said jaws being movable to an open position in the event of said predetermined lateral force.

5. The apparatus of claim 4 including ball-receiving recesses in the jaws, balls mounted on the middle portion, spring means biasing the balls in to the ball-receiving recesses on the jaws tending to keep said jaws in the closed position.

6. The apparatus of claim 5 including means connected to the middle portion for adjusting the force exerted by said spring means.

7. The apparatus of claim 6 in which the adjusting means includes an adjusting screw for adjusting the force of the spring means.

8. The apparatus of claim 7 wherein the adjusting screw is a screw with a conical end, and the adjusting means includes push pieces interposed between said conical end and the respective spring means associated with said balls.

* * * * *